US008884148B2

(12) United States Patent
Gurule

(10) Patent No.: US 8,884,148 B2
(45) Date of Patent: Nov. 11, 2014

(54) SYSTEMS AND METHODS FOR TRANSFORMING CHARACTER STRINGS AND MUSICAL INPUT

(76) Inventor: Randy Gurule, Bartlesville, OK (US)

( * ) Notice: Subject to any disclaimer, the term of this patent is extended or adjusted under 35 U.S.C. 154(b) by 0 days.

(21) Appl. No.: 13/535,708

(22) Filed: Jun. 28, 2012

(65) Prior Publication Data

US 2013/0000465 A1 Jan. 3, 2013

Related U.S. Application Data

(60) Provisional application No. 61/501,940, filed on Jun. 28, 2011.

(51) Int. Cl.
*G10H 1/18* (2006.01)

(52) U.S. Cl.
USPC ..... 84/615; 84/653; 84/609; 84/649

(58) Field of Classification Search
USPC ..... 84/609, 615, 649, 653
See application file for complete search history.

(56) References Cited

U.S. PATENT DOCUMENTS

| | | | | |
|---|---|---|---|---|
| 4,104,949 | A * | 8/1978 | Clark | 84/462 |
| 4,352,313 | A * | 10/1982 | Ny | 84/425 |
| 4,603,386 | A * | 7/1986 | Kjaer | 84/461 |
| 5,151,873 | A * | 9/1992 | Hirsh | 708/172 |
| 5,971,635 | A * | 10/1999 | Wise | 400/473 |
| 6,121,536 | A * | 9/2000 | Malcolm | 84/645 |
| 6,424,944 | B1 * | 7/2002 | Hikawa | 704/260 |
| 6,956,848 | B1 * | 10/2005 | Keung et al. | 370/356 |
| 7,430,554 | B1 * | 9/2008 | Heisinger, Jr. | 1/1 |
| 7,465,867 | B2 * | 12/2008 | Glatt | 84/645 |
| 7,482,529 | B1 * | 1/2009 | Flamini et al. | 84/645 |
| 7,674,970 | B2 * | 3/2010 | Ma et al. | 84/627 |
| 7,705,232 | B2 * | 4/2010 | Glatt | 84/645 |
| 7,937,115 | B2 * | 5/2011 | Albers | 455/567 |
| 8,426,713 | B1 * | 4/2013 | Sardo | 84/423 R |
| 2003/0161425 | A1 * | 8/2003 | Kikuchi | 375/354 |
| 2004/0198471 | A1 * | 10/2004 | Deeds | 455/575.1 |
| 2005/0005760 | A1 * | 1/2005 | Hull et al. | 84/645 |
| 2005/0056144 | A1 * | 3/2005 | Yang et al. | 84/719 |
| 2005/0190903 | A1 * | 9/2005 | Viikki | 379/142.01 |
| 2007/0079692 | A1 * | 4/2007 | Glatt | 84/645 |
| 2007/0218964 | A1 * | 9/2007 | Albers | 455/701 |
| 2007/0256551 | A1 * | 11/2007 | Knapp et al. | 84/722 |
| 2008/0115656 | A1 * | 5/2008 | Sumita | 84/612 |
| 2008/0210082 | A1 * | 9/2008 | Sumita | 84/603 |
| 2008/0271592 | A1 * | 11/2008 | Beckford | 84/645 |
| 2009/0064852 | A1 * | 3/2009 | Glatt | 84/645 |
| 2009/0171485 | A1 * | 7/2009 | Sim et al. | 700/94 |
| 2009/0254206 | A1 * | 10/2009 | Snowdon et al. | 700/94 |
| 2010/0089223 | A1 * | 4/2010 | Ting | 84/610 |
| 2011/0004467 | A1 * | 1/2011 | Taub et al. | 704/207 |

(Continued)

OTHER PUBLICATIONS

MIDI specification, viewed online at http://www.midi.org/techspecs/midispec.php. 1993.*

*Primary Examiner* — David S. Warren
(74) *Attorney, Agent, or Firm* — John M. Behles

(57) ABSTRACT

Systems and methods for transforming character strings and musical input are provided herein. According to some embodiments, methods for transforming character strings into musical output may include executing instructions stored in memory via a processor to determine a scheme for converting character strings into musical output, receive the character string, parse the character string into character segments, and convert the character segments into individual musical notes according to the scheme to create the musical output.

18 Claims, 8 Drawing Sheets

(56) References Cited

U.S. PATENT DOCUMENTS

2011/0100198 A1* 5/2011 Gatzsche et al. ..... 84/615
2011/0237247 A1* 9/2011 Best et al. ..... 455/427
2012/0047216 A1* 2/2012 Rhie et al. ..... 709/206
2012/0065977 A1* 3/2012 Tepperman et al. ..... 704/258
2012/0067195 A1* 3/2012 Skaggs et al. ..... 84/477 R
2013/0000465 A1* 1/2013 Gurule ..... 84/609
2013/0025434 A1* 1/2013 Gannon ..... 84/613

* cited by examiner

SYSTEMS AND METHODS FOR TRANSFORMING CHARACTER STRINGS AND MUSICAL INPUT

CROSS-REFERENCE TO RELATED APPLICATION(S)

This Non-Provisional U.S. patent application claims the priority benefit of U.S. Provisional Application Ser. No. 61/501,940, filed on Jun. 28, 2011, which is hereby incorporated by reference herein in its entirety including all references cited therein.

BACKGROUND OF THE INVENTION

1. Field of the Invention

The present invention relates in general to systems and methods for transforming character strings, such as strings of alphanumeric characters, into musical output. More particularly, but not by way of limitation, the present technology may comprise systems and methods for transforming character strings such as lyrics, names, dates, and the like into musical output such as musical notation, musical tablature, audio files, and the like. Additionally, musical input may be transformed into character output.

2. Background Art

Systems and methods for producing musical compositions are well known in the art. While many systems and methods are well known, Applicant is unaware of any systems or methods adapted to transform character strings into musical notation (e.g., notes, scores, compositions, etc.), musical tablature, audio files, and the like.

As such, the present invention is directed to systems and methods for transforming character strings into musical notation, musical tablature, audio files, and the like. These and other objects of the present invention will become apparent in light of the present specification, claims, and drawings.

SUMMARY OF THE INVENTION

According to some embodiments, the present disclosure may be directed to methods for transforming character strings into musical output. These methods may comprise: (a) executing instructions stored in memory via a processor to: (i) receive the character string; (ii) parse the character string into character segments; and (iii) automatically select a scheme for converting the character segments into a musical output based upon an evaluation of the character segments; and (iv) convert the character segments into individual musical notes according to the scheme to create the musical output.

According to additional embodiments, the present disclosure may be directed to systems for transforming character strings into musical output. These systems may comprise: (a) a memory for storing executable instructions; and (b) a processor for executing the executable instructions, the executable instructions comprising: (i) an analysis module that: (1) determines a scheme for converting character strings into musical output; (2) receives the character string; (3) parses the character string into individual characters; and (4) converts the individual characters into individual musical notes according to the scheme to create the musical output.

According to some embodiments, the present disclosure may be directed to methods for transforming musical input into a character output. These methods may comprise: (a) receiving a musical input; (b) converting the musical input into music notes; (c) selecting a scheme for converting character strings into musical output; and (d) converting the music notes into character segments according to the scheme to create the character output.

BRIEF DESCRIPTION OF THE DRAWINGS

Certain embodiments of the present invention are illustrated by the accompanying figures. It will be understood that the figures are not necessarily to scale and that details not necessary for an understanding of the invention or that render other details difficult to perceive may be omitted. It will be understood that the invention is not necessarily limited to the particular embodiments illustrated herein.

DETAILED DESCRIPTION OF EXEMPLARY EMBODIMENTS

Figure 1:
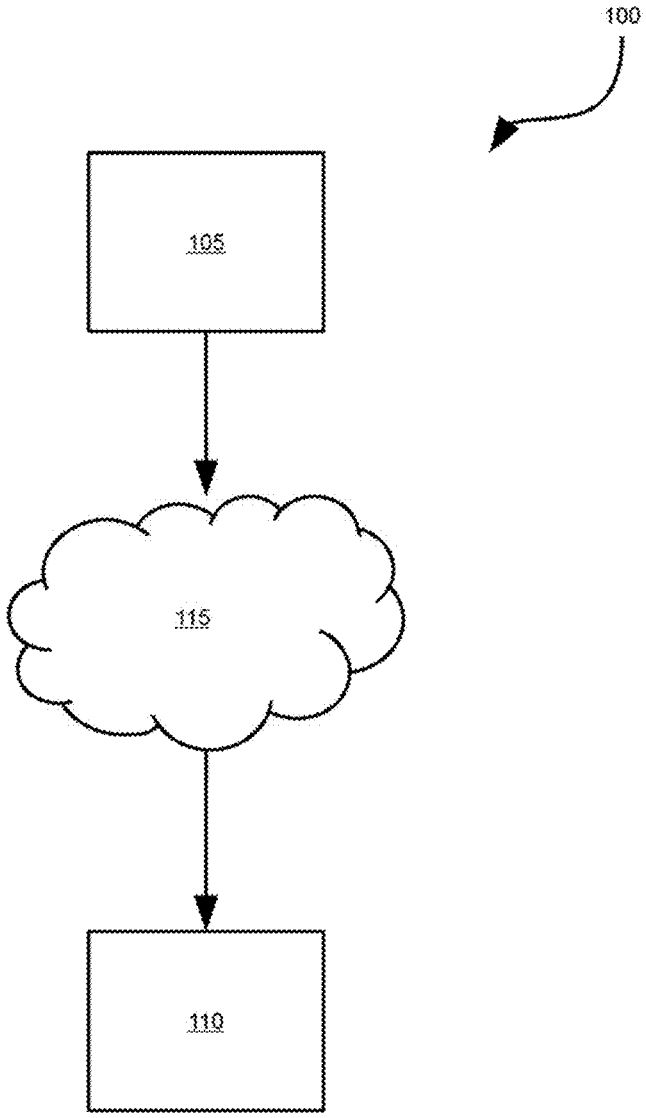
FIG. 1 is an exemplary environment for practicing one or more embodiments of the present invention.
Figure 2:
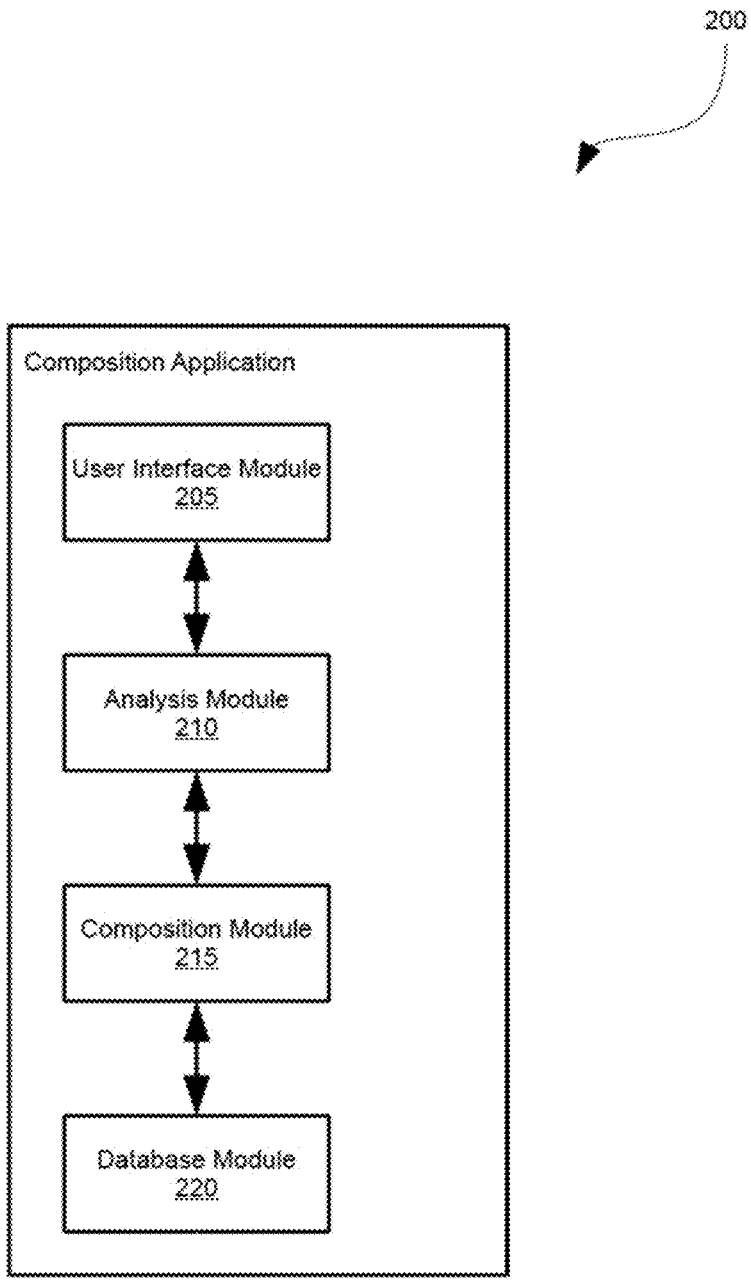
FIG. 2 is a block diagram of a composition application for use in accordance with some embodiments of the present invention.

While this invention is susceptible of embodiment in many different forms, there is shown in the drawings and will herein be described in detail several specific embodiments with the understanding that the present disclosure is to be considered as an exemplification of the principles of the invention and is not intended to limit the invention to the embodiments illustrated.

It will be understood that like or analogous elements and/or components, referred to herein, may be identified throughout the drawings with like reference characters.

Referring now to the drawings and more particularly, to FIGS. 1-3B collectively, exemplary architecture 100 that may be utilized to implement embodiments of the present invention is shown. According to some embodiments, architecture 100 includes one or more user devices 105, such as a computing system, which is described in greater with regards to computing system 400 as shown in FIG. 4. Each user device 105 may be operatively connected to application server(s) 110 via network 115. It will be understood that network 115 may include any number of communication mediums such as LAN (Local Area Network), WAN (Wide Area Network), the Internet, a VPN (Virtual Private Network) tunnel, or combinations thereof.

Composition application 200 may reside on application server 110, although it will be understood that all or a portion of composition application 200 may reside locally on user device 105. Generally speaking, composition application 200 may include user interface module 205, analysis module 210, optional composition module 215, and database module 220. It is noteworthy that the server-side application 205 may include additional modules, engines, or components, and still fall within the scope of the present technology. As used herein, the term "module" may also refer to any of an application-specific integrated circuit ("ASIC"), an electronic circuit, a processor (shared, dedicated, or group) that executes one or more software or firmware programs, a combinational logic circuit, and/or other suitable components that provide the described functionality. In other embodiments, individual modules of the composition application 200 may include separately configured web servers.

It will be understood that composition application 200 may be included as a constituent module of a digital audio workstation or digital audio workstation application that resides on at least one of user device 105, application server(s) 110, or in an executable form as a non-transitory computer readable storage medium having a program embodied thereon, the program executable by a processor in a computing system (e.g., computing system 400 as shown in FIG. 4) to perform one or more of the methods described herein. Digital audio workstations are well known in the art and it would be well within the level of one of ordinary skill the art to incorporate the features of composition application 200 within such digital audio workstation applications. For the sake of brevity, a detailed discussion of the entire process for incorporating the features of composition application 200 within a digital audio workstation or digital audio workstation application will not be included.

Generally speaking, user interface module 205 is adapted to generate one or more user interfaces that allow end users to interact with composition application 200. Although not shown, one exemplary user interface may receive information indicative of an end user, for establishing a user profile that may reside on a database associated. The user profile may be stored on at least one of user device 105 or application server(s) 110. In some embodiments, the user interface may include a plurality of input devices adapted to receive input indicative of, for example, a username, a password, and one or more character strings—just to name a few.

Input indicative of one or more character strings, such as letters of an alphabet may include, for example, first, middle, and/or last name of an entity (e.g., person, company, business, school, etc.), lyrics, and/or excerpts from written works of art (e.g., books, magazines, newspapers, etc.).

Analysis module 210 may be adapted to receive information indicative of character strings from received by user interface module 205 and transform such input into musical output such as notes, compositions, scores, and the like. Analysis module 210 may utilize one or more algorithms to process the received input and transform the character strings into musical output.

According to some embodiments, analysis module 210 may be adapted to parse character strings into character segments and convert the character segments into musical notes according to one or more schemes. The terms "character segments" may be understood to include individual characters or groups of characters such as letter combinations, words, and so forth. According to additional embodiments, the analysis module 210 may convert special case letters or combinations of letters into standards characters in an alphabet. For example, a double LL, such as used in the Spanish language may be converted to a singular L for purposes of converting the character into a musical note. Similarly, the analysis module 310 may be adapted to convert the character "ç" to K. These conversions may be established by the end user, or may be predefined within the system.

Figure 3A:
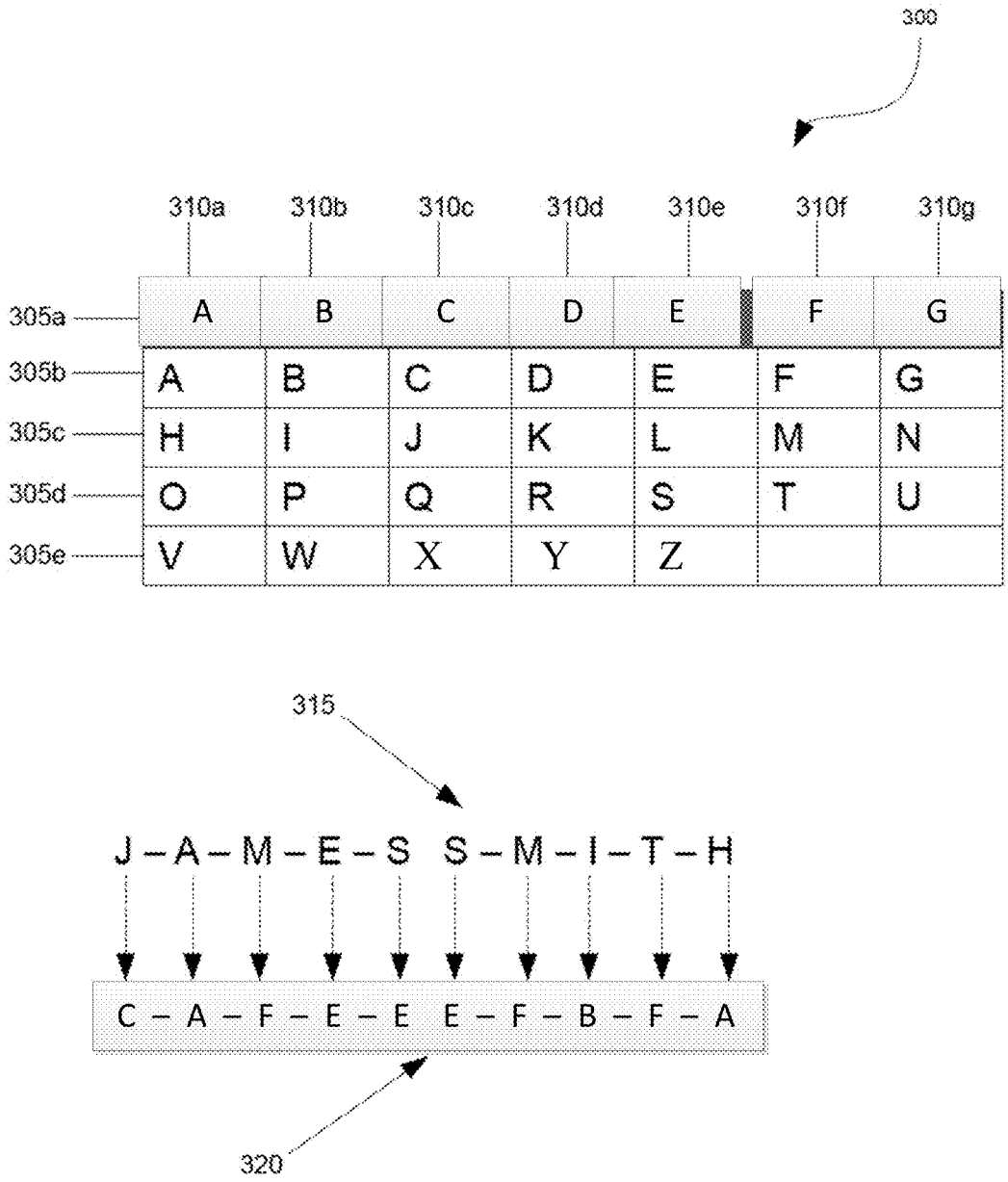
FIG. 3A is a diagrammatical view of the transformation of a characters string into musical output.
Figure 4:
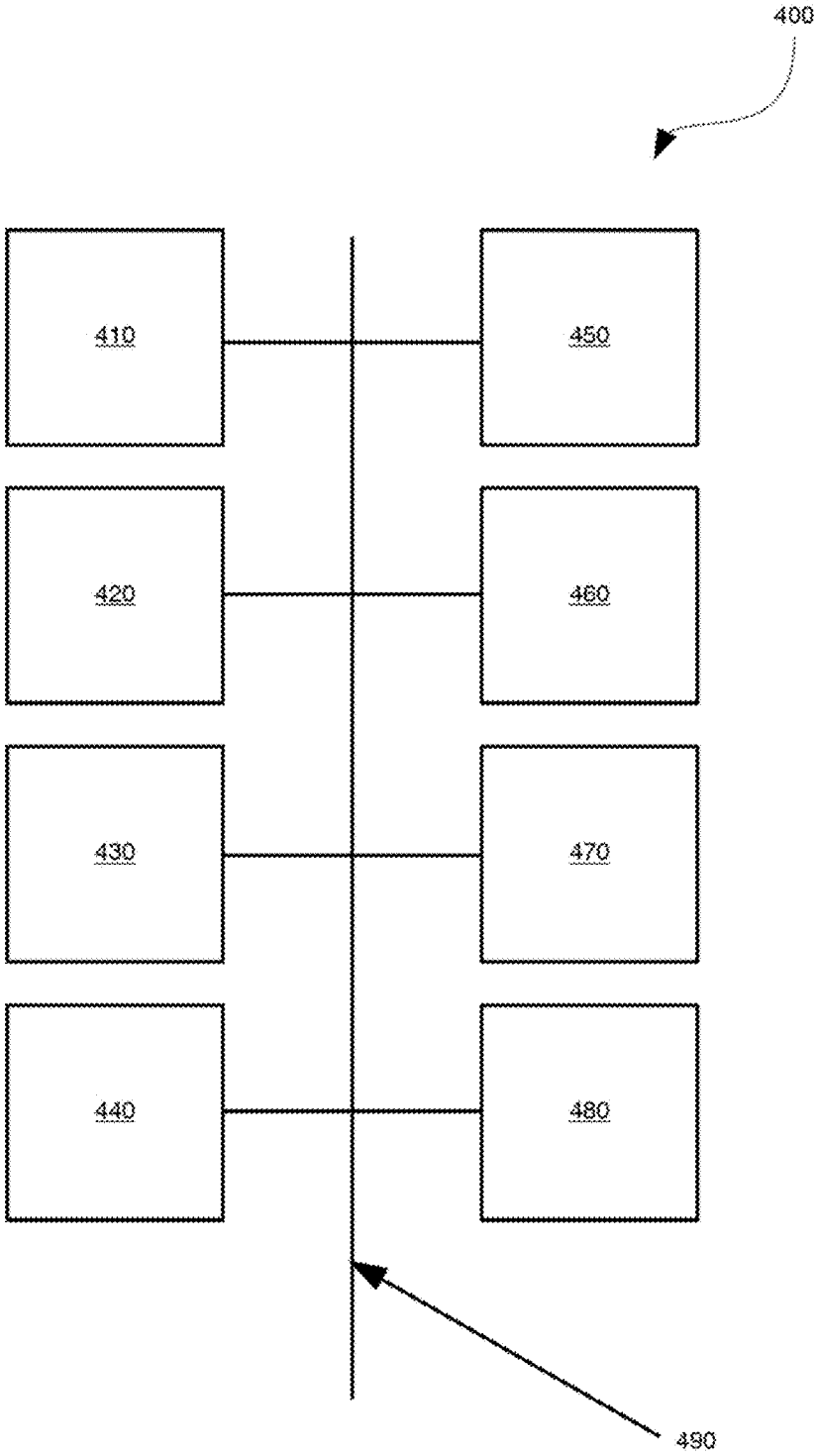
FIG. 4 is a block diagram of an exemplary computing system for executing one or more functions of a method for transforming character strings into musical output, in accordance with various embodiments of the present invention.

FIG. 3A illustrates a first scheme 300, shown as a matrix having rows 305*a*-3 and columns 310*a-g* wherein the first row 305*a* includes seven musical notes (A-B-C-D-E-F-G) with one note placed in each of the columns 310*a-g*. It will be understood that many other scales that would be known to one or ordinary skill in the art may be utilized according to the present invention, for example, all major and minor scales, diatonic scales, whole tone scales, pentatonic scales, hexatonic scales, heptatonic scales, Hungarian minor scales, and the like. It will further be understood that the scheme may include alternative numbers of rows and columns that may vary according to whether whole or half notes are included in the scheme.

According to some embodiments, end users may select or create a scheme that may be used to transform a character string into musical output. For example, using scheme 300, the matrix may be associated with the letters of the alphabet beginning with the letter "A" in row 305*b*, column 310*a* with subsequent letters being placed in succession until the matrix is filled such that the letter "Z" occupies the row 305*e*, column 310*g*. Letter combinations such as "ae" or "ie" may be placed in free cells within the matrix. Similarly, words may also be placed in a cell.

Non-limiting examples of transformations performable by analysis module 210 include receiving input corresponding to a two word character string 315 of "James Smith," parsing the string into individual characters (J-a-m-e-s S-m-i-t-h) and transforming the individual characters into musical notes utilizing scheme 300. Therefore, "J" may be transformed into the musical note of "C" as the letter "J" resides in column 310*c* associated with or assigned the musical note of "C." Each of the letters is similarly translated by analysis module 210 to create musical output 320 equal to (C, A, F, E, E E, F, B, F, A). It will be understood that in this example, that the musical output 320 may be interpreted as individual musical notes or musical chords. It will further be understood that modifying the scheme utilized to translate the received character string may produce a complete different and sometimes complementary musical output that may be utilized in place of, or in combination with musical output 320. In additional embodiments, the matrix may include any number or arrangements of letters, symbols, numbers, special characters, and so forth. Schemes may be created for other character sets. For example, a scheme may be created for characters sets in different languages such as Japanese, Chinese, Hebrew, and so forth. In other embodiments, a scheme may be created for non-standard character sets such as Wingding™.

In greater detail, analysis module 210 may communicate the received character string 315 and the musical output 320 to composition module 215. Although not shown, composition module 215 may be adapted to associate the musical output 320 with the character string 315 in a commonly utilized form such musical notation, musical tablature, or musical scores—just to name a few.

Figure 3B:
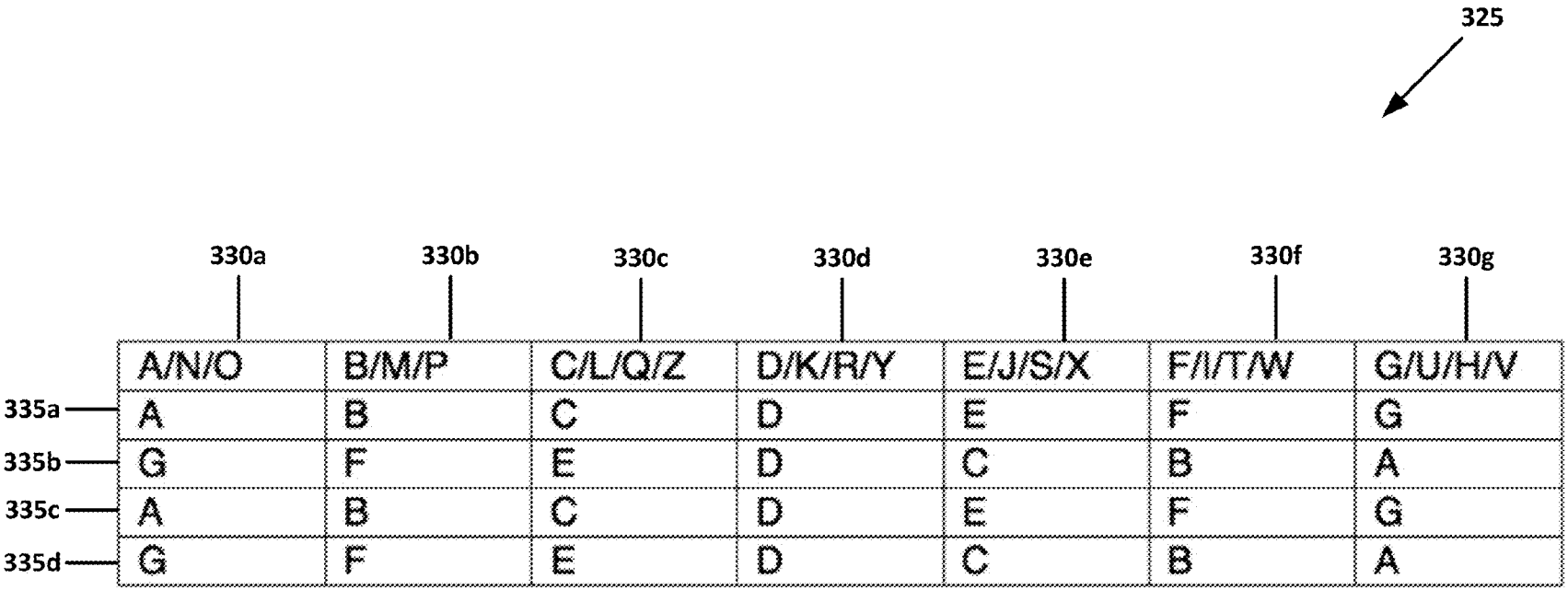
FIG. 3B illustrates another scheme for transforming character strings into musical output.

FIG. 3B illustrates another exemplary scheme 325, shown as a matrix. The scheme 325 may comprise seven columns 330*a-g*, where each column corresponds to one or more characters of the English alphabet. For example, column 330*a* may comprise the letters A, N, and O. The rows 335*a-d*, comprise the musical notes (A-G), where the notes are arranged in reverse in an alternating pattern. For example, row 335*a* has the musical notes arranged from A-G such that the musical note A falls under the letter A, N, and O. Contrastingly, row 335*b* has the musical notes arranged from G-A.

Therefore, one of ordinary skill in the art will appreciate that many different types of character strings may be utilized to create musical output corresponding to the scheme utilized to by analysis module 210. In additional examples, analysis module may transform written lyrics into musical output that may be utilized as the musical component of a song that includes the lyrics.

While it has been disclosed that composition module 200 may be adapted to receive and transform character strings such as names, it will be understood that composition module 200 may be adapted to transform names and birthdates in the form of purely numeric dates or combinations of words and numerical data. Additionally, composition module 200 may be adapted to transform arbitrary symbols such as &, *, $, ), and the like by creating alternative schemes.

According to some embodiments, the end user may select the appropriate scheme that is to be used to transform a character string into a musical output. In other embodiments, the analysis module 210 may be configured to automatically select a scheme for converting character strings into musical output based upon an evaluation of the individual characters. For example, the analysis module 210 may evaluate each of the characters parsed from the character string to determine if there are special or non-standard characters. That is, the inclusion of non-standard or special characters may cause the analysis module 210 to select a different scheme relative to a scheme that would be selected if the character string included only standard, English alphabet characters. Alternatively, the analysis module 210 may select a scheme for the character string if the characters indicate a language for the character string.

According to some embodiments, rather than converting character strings into musical output, the present technology may be configured to convert musical input into a character output. Thus, the analysis module 210 may receive a musical input such as an audio file, a multimedia file, sheet music, a score, tablature, or any other medium that represents musical information such as music notes, either in the form of single notes, chords, or other groups of musical notes. The analysis module 210 may determine individual musical notes or chords included in the musical input. In some instances, the analysis module 210 may decompose a more complex musical input such as a score into a plurality of sets of musical notes.

Once the analysis module 210 has determined musical notes from the musical input, the analysis module 210 may apply one or more schemes to the musical input to convert the musical notes into characters. Thus, conceptually, the analysis module 210 may convert character strings to musical output, or alternatively, musical input into character output. The analysis module 210 may convert the musical notes to characters using the aforementioned matrices or other similar matrices. When using a scheme, it is apparent that a musical note may be associated with more than one character. For example, the first scheme 300 of FIG. 3A illustrates that the musical note "A" is potentially associated with the letters A, H, O, and V. Thus, the analysis module 210 may associate each musical note with one or more possible character transformations. Therefore, even a small grouping of musical notes may yield a relatively large number of possible character transformations. Using these possible character transformations, the analysis module 210 may employ pattern recognition features to determine words or phrases that may be assembled from the possible character transformations.

Figure 3C:
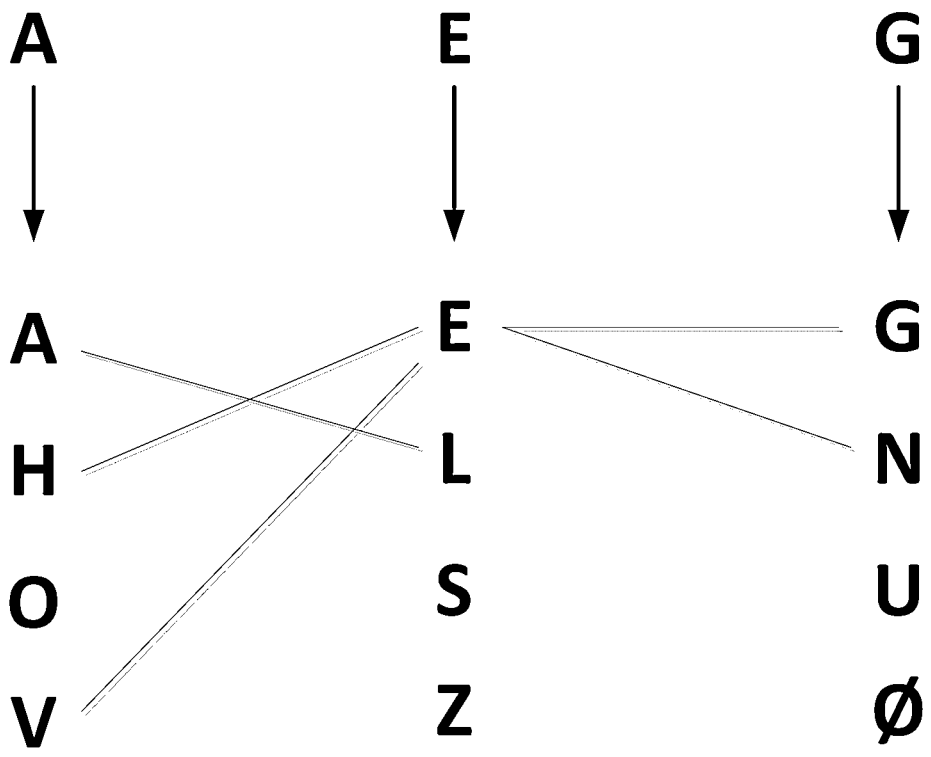
FIG. 3C illustrates a transformation of musical notes to character segments.

FIG. 3C illustrates a transformation of musical notes to character segments. Again, a character segment may comprise a portion of a word such as a letter or combination of letters. Musical notes A, E, and G are shown as having possible character combinations of [A, H, O, V], [E, L, S, Z], and [G, N, U, and Null]. Using simple combinations of these possible characters, the analysis module 210 may choose to translate the A, E, and G as "AON," "HEN," VEG," "HE," "AS," "AL," and so forth. Additionally, other, more complicated permutations may be created by, for example, treating the possible characters for each note as a vector and applying various mathematical equations to the vectors that would be known to one or ordinary skill in the art. Thus, a plurality of alternative translations/transformations may be generated for each musical input. In some instances, the composition module 215 may combine a character output with the musical input from which it was generated. Thus, lyrics for a musical input may be generated using the musical input as the basis for the creation of the lyrics.

According to some embodiments, a relative highness or lowness for a musical note may also be used by the analysis module 210 to select or narrow down which of the possible alternatives should be selected. Using the example above, if the musical note is "A" the analysis module 210 may select letters A or H if the note is relatively low (e.g., resides on or near the bass clef). Conversely, the "A" musical note may be transformed as an O or V if the note is relatively low (e.g., resides on or near the treble clef). Two "A" musical notes in the same musical input may also be used in a comparative fashion, where the lower A and higher A are transformed into different characters.

Figure 3D:
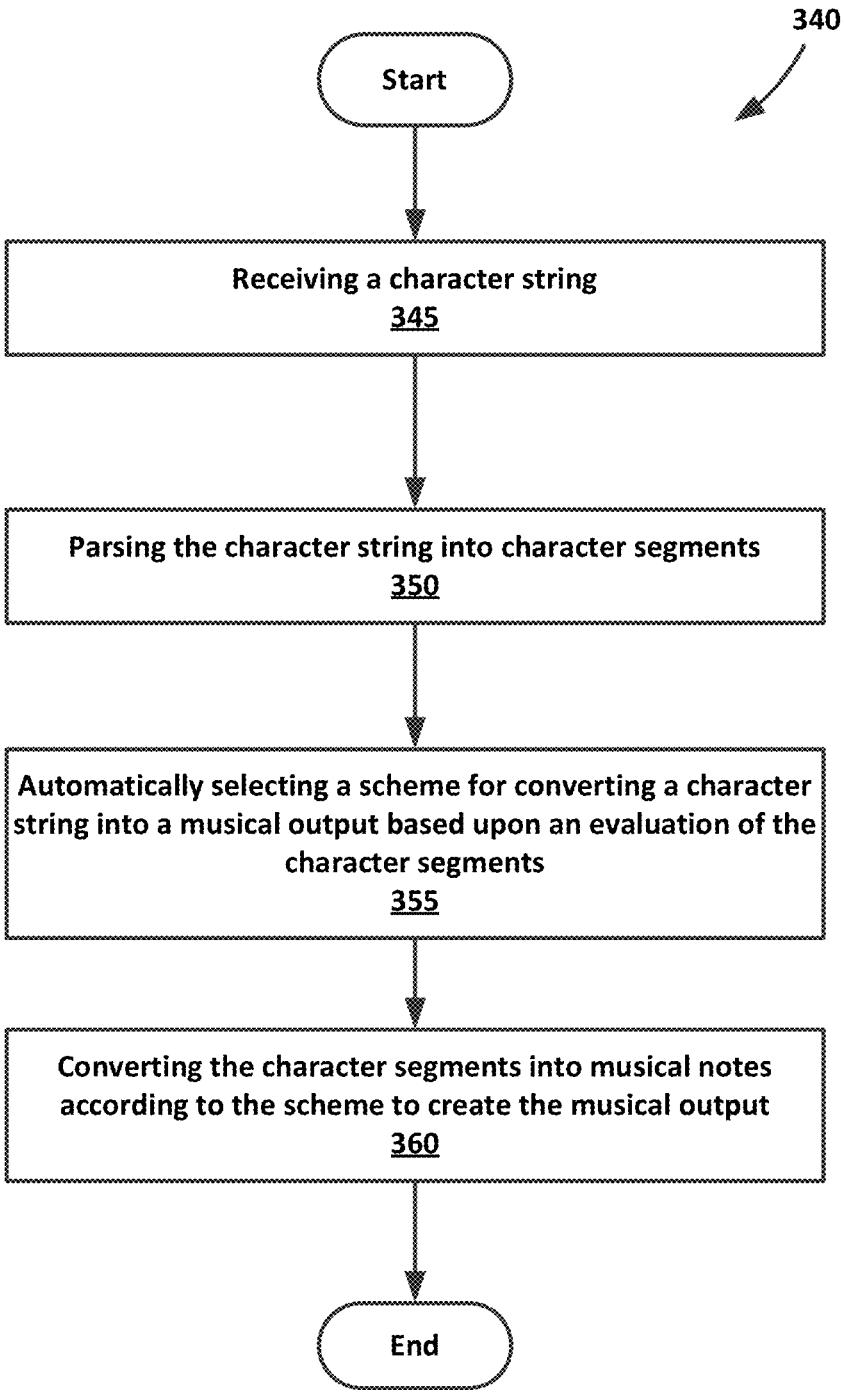
FIG. 3D is a flowchart of an exemplary method for transforming character strings into musical output.
Figure 3E:
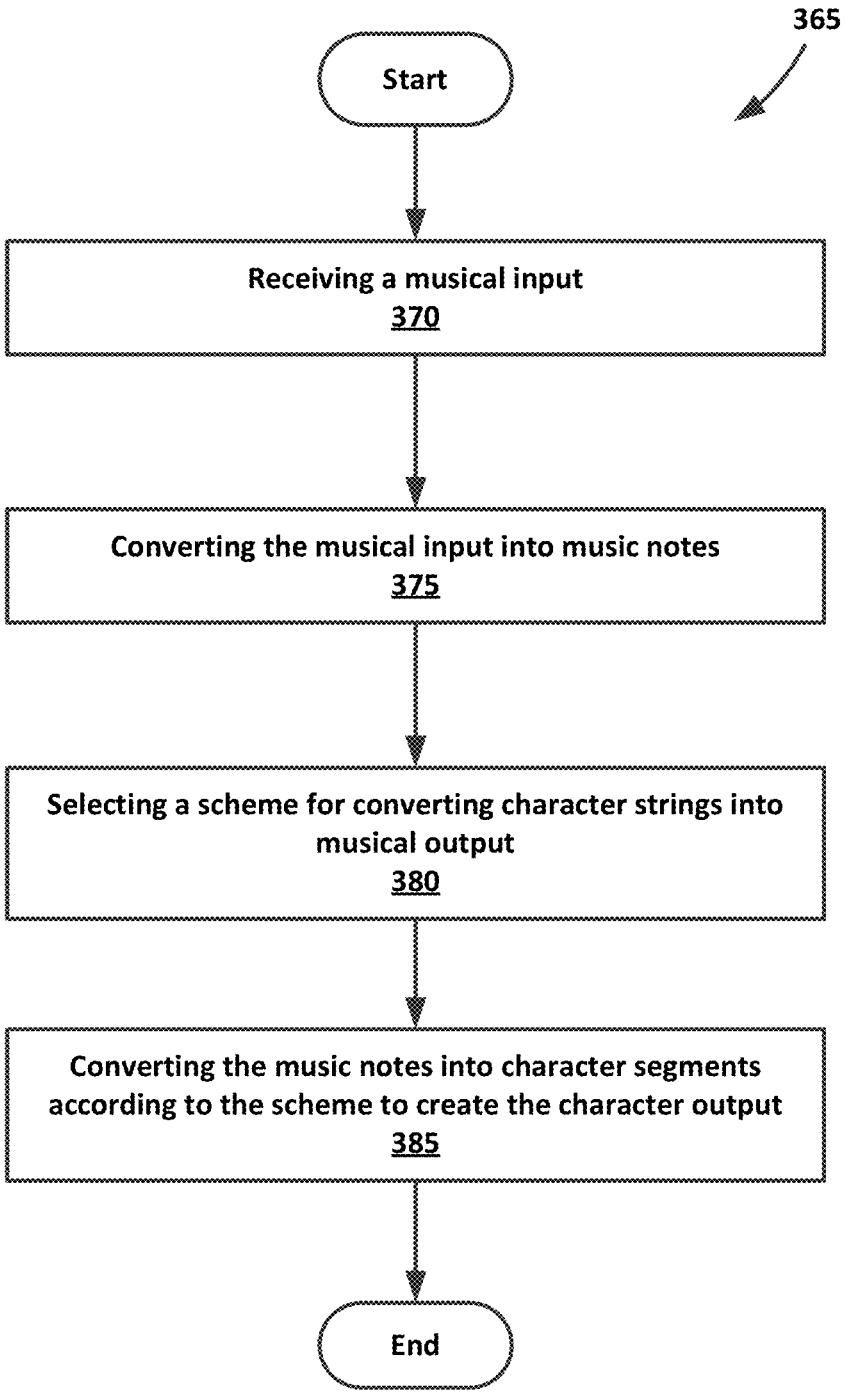
FIG. 3E is a flowchart of another exemplary method for transforming character strings into musical output.

FIG. 3D illustrates a flowchart of another exemplary method for transforming character strings into musical output. The method 340 may comprise a step 345 of receiving a character string, a step 350 of parsing the character string into character segments, a step 355 of automatically selecting a scheme for converting character strings into musical output based upon an evaluation of the character segments, and a step 360 of converting the character segments into individual musical notes according to the scheme to create the musical output.

FIG. 3D illustrates a flowchart of another exemplary method for transforming musical input into character output. The method 365 may comprise a step 370 of receiving a musical input, a step 375 of converting the musical input into music notes, a step 380 of selecting a scheme for converting character strings into musical output, and a step 385 of converting the music notes into character segments according to the scheme to create the character output.

FIG. 4 illustrates an exemplary computing system 400 that may be used to implement various portions of the present invention. Computing system 400 of FIG. 4 may be implemented in the context of user devices 105, application server(s) 110, and the like. The computing system 400 of FIG. 4 includes one or more processors 410 and memory 420. Main memory 420 stores, in part, instructions and data for execution by processor 410. Main memory 420 can store the executable code when computing system 400 is in operation. Computing system 400 of FIG. 4 may further include mass storage device 430, portable storage medium drive(s) 440, output devices 450, user input devices 460, graphics display 470, and other peripheral devices 480.

The components shown in FIG. 4 are depicted as being connected via single bus 490. The components may be connected through one or more data transport means. Processor unit 410 and main memory 420 may be connected via a local microprocessor bus, and mass storage device 430, peripheral device(s) 480, portable storage medium drive 440, and graphics display 470 may be connected via one or more input/output (I/O) buses.

Mass storage device 430, which may be implemented with a magnetic disk drive or an optical disk drive, is a non-volatile storage device for storing data and instructions for use by processor 410. Mass storage device 430 can store the system software for implementing embodiments of the present invention for purposes of loading that software into main memory 420.

Portable storage medium drive 440 operates in conjunction with a portable non-volatile storage medium, such as a floppy disk, compact disk or Digital video disc, to input and output data and code to and from computing system 400 of FIG. 4. The system software for implementing embodiments of the present invention may be stored on such a portable medium and input into computing system 400 via portable storage medium drive 440.

Use input devices 460 provide a portion of a user interface. User input devices 460 may include an alphanumeric keypad, such as a keyboard, for inputting alphanumeric and other information, or a pointing device, such as a mouse, a trackball, stylus, or cursor direction keys. Additionally, computing system 400 as shown in FIG. 4 includes output devices 450. Suitable output devices include speakers, printers, network interfaces, and monitors.

Graphics display 470 may include a liquid crystal display (LCD) or other suitable display device. Graphics display 470 receives textual and graphical information, and processes the information for output to the display device.

Peripheral devices 480 may include any type of computer support device to add additional functionality to the computer system. Peripheral device(s) 480 may include a modem or a router.

The components contained in computing system 400 of FIG. 4 are those typically found in computer systems that may be suitable for use with embodiments of the present invention and are intended to represent a broad category of such computer components that are well known in the art. Thus, computing system 400 of FIG. 4 can be a personal computer, hand held computing system, mobile gaming devices, telephone, automated bank teller machine (ATM), mobile computing system, workstation, server, minicomputer, mainframe computer, or any other computing system. The computer can also include different bus configurations, networked platforms, multi-processor platforms, etc. Various operating systems can be used including UNIX, Linux, Windows, Macintosh OS, Palm OS, iOs, and other suitable operating systems.

Some of the above-described functions may be composed of instructions that are stored on storage media (e.g., computer-readable medium). The instructions may be retrieved and executed by the processor. Some examples of storage media are memory devices, tapes, disks, and the like. The instructions are operational when executed by the processor to direct the processor to operate in accord with the invention. Those skilled in the art are familiar with instructions, processor(s), and storage media.

It is noteworthy that any hardware platform suitable for performing the processing described herein is suitable for use with the invention. The terms "computer-readable storage medium" and "computer-readable storage media" as used herein refer to any medium or media that participate in providing instructions to a CPU for execution. Such media can take many forms, including, but not limited to, non-volatile media, volatile media and transmission media. Non-volatile media include, for example, optical or magnetic disks, such as a fixed disk. Volatile media include dynamic memory, such as system RAM. Transmission media include coaxial cables, copper wire and fiber optics, among others, including the wires that comprise one embodiment of a bus. Transmission media can also take the form of acoustic or light waves, such as those generated during radio frequency (RF) and infrared (IR) data communications. Common forms of computer-readable media include, for example, a floppy disk, a flexible disk, a hard disk, magnetic tape, any other magnetic medium, a CD-ROM disk, digital video disk (DVD), any other optical medium, any other physical medium with patterns of marks or holes, a RAM, a PROM, an EPROM, an EEPROM, a FLASHEPROM, any other memory chip or cartridge, a carrier wave, or any other medium from which a computer can read.

Various forms of computer-readable media may be involved in carrying one or more sequences of one or more instructions to a CPU for execution. A bus carries the data to system RAM, from which a CPU retrieves and executes the instructions. The instructions received by system RAM can optionally be stored on a fixed disk either before or after execution by a CPU.

While various embodiments have been described above, it should be understood that they have been presented by way of example only, and not limitation. The descriptions are not intended to limit the scope of the technology to the particular forms set forth herein. Thus, the breadth and scope of a preferred embodiment should not be limited by any of the above-described exemplary embodiments. It should be understood that the above description is illustrative and not restrictive. To the contrary, the present descriptions are intended to cover such alternatives, modifications, and equivalents as may be included within the spirit and scope of the technology as defined by the appended claims and otherwise appreciated by one of ordinary skill in the art. The scope of the technology should, therefore, be determined not with reference to the above description, but instead should be determined with reference to the appended claims along with their full scope of equivalents.

What is claimed is:

1. A method for transforming character strings into musical output, the method comprising:

executing instructions stored in memory via a processor to:

receive a character string;

parse the character string into character segments;

select a scheme for converting the character string into a musical output based upon an evaluation of the character segments, wherein the scheme comprises a matrix, the matrix comprising a plurality of columns and a plurality of rows, wherein each of the plurality of columns is associated with at least one musical note selected from a scale and each cell of the rows is associated with at least one character of an alphabet such that each letter of the alphabet is included in the matrix, wherein the scale is selected by an end user; and convert the character segments into musical notes according to the scheme to create the musical output.

2. The method according to claim 1, further executing the instructions stored in memory via the processor to convert non-standard characters found in the character string into standard characters, wherein the standard characters are single alphabetic characters, further wherein the non-standard characters are any characters that are: (i) not single alphabetic characters; or (ii) not English alphabetic characters.

3. The method according to claim 2, wherein the non-standard characters are convertible to standard characters using end user defined conversions.

4. The method according to claim 2, further comprising selecting a first scale for the scale if the character string includes one or more non-standard characters and selecting a second scale for the scale if the character string includes only standard characters.

5. The method according to claim 1, further executing the instructions stored in memory via the processor to convert the music notes into a musical composition.

6. The method according to claim 5, further executing the instructions stored in memory via the processor to combine the musical composition with the character string to create a musical composition with lyrics.

7. The method according to claim 1, wherein a character segment is transformed into a musical note according to the scheme by locating the cell assigned to the character segment in the matrix and assigning the character segment a musical note, wherein the musical note includes the musical note for the column in which the character is located.

8. The method according to claim 1, wherein a number of the plurality of columns is selected based upon whether the scale includes whole or half notes.

9. The method according to claim 1, further comprising modifying the scheme by selecting a new scale and using the modified scheme to produce complementary musical output for the musical output.

10. A system for transforming character strings into musical output, the system comprising:

a memory for storing executable instructions; and a processor for executing the executable instructions, the executable instructions comprising:

an analysis module that:

receives a character string;

parses the character string into individual characters;

selects a scheme for converting character strings into musical output based upon an evaluation of the individual characters, wherein the scheme comprises a matrix, the matrix comprising a plurality of columns and a plurality of rows, wherein each of the plurality of columns is associated with at least one musical note selected from a scale and each cell of the rows is associated with at least one character of an alphabet such that each letter of the alphabet is included in the matrix, wherein a number of the plurality of columns is selected based upon whether the scale includes whole or half notes; and converts the individual characters into individual musical notes according to the scheme to create the musical output.

11. The system according to claim 10, wherein the analysis module further converts non-standard individual characters found in the character string into standard individual characters, wherein the standard characters are single alphabetic characters, further wherein the non-standard characters are any characters that are: (i) not single alphabetic characters; or (ii) not English alphabetic characters.

12. The system according to claim 10, wherein the executable instructions further comprise a composition module that converts the individual music notes into a musical composition.

13. The system according to claim 12, wherein the composition module further combines the musical composition with the character string to create a musical composition with lyrics.

14. The system according to claim 10, wherein the analysis module transforms a character segment into a musical note according to the scheme by locating the cell assigned to the character segment in the matrix and assigning the character segment a musical note, wherein the musical note includes the musical note for the column in which the character is located.

15. A method for transforming musical input into character output, the method comprising:

executing instructions stored in memory via a processor to:

receive a musical input;

parse the musical input into musical notes; and select a scheme for converting a musical input into character segments select, wherein the scheme comprises a matrix, the matrix comprising a plurality of columns and a plurality of rows, wherein each of the plurality of columns is associated with at least one musical note selected from a scale and each cell of the rows is associated with at least one character of an alphabet such that each letter of the alphabet is included in the matrix;

convert the musical notes into character segments according to the scheme to create the character output;

modifying the scheme by selecting a different scale; and using the modified scheme to produce complementary musical output for the musical output.

16. The method according to claim 15, wherein convert the musical notes into character segments further comprises selecting one or more possible character segments for each musical note.

17. The method according to claim 16, further comprising applying pattern recognition to the one or more possible character segments for each musical note and generating any of words, phrases, sentences, or any combinations thereof from the one or more possible character segments.

18. The method according to claim 15, wherein the scale is selected by an end user.

* * * * *